US006864841B2

(12) United States Patent
Dai et al.

(10) Patent No.: US 6,864,841 B2
(45) Date of Patent: Mar. 8, 2005

(54) MULTI-BAND ANTENNA

(75) Inventors: Hsin Kuo Dai, Tu-chen (TW); Lung-sheng Tai, Tu-chen (TW); Hsien-Chu Lin, Tu-chen (TW); Chia-Ming Kuo, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/327,551

(22) Filed: Dec. 20, 2002

(65) Prior Publication Data

US 2004/0090377 A1 May 13, 2004

(30) Foreign Application Priority Data

Nov. 8, 2002 (TW) ..... 91217912

(51) Int. Cl.[7] ..... H01Q 1/38

(52) U.S. Cl. ..... 343/700 MS; 343/725; 343/741; 343/866; 343/848

(58) Field of Search ..... 343/700 MS, 702, 343/725, 741, 866, 829, 846, 848

(56) References Cited

U.S. PATENT DOCUMENTS 6,002,367 A 12/1999 Engblom et al.
6,034,640 A * 3/2000 Oida et al. ..... 343/722
6,067,052 A * 5/2000 Rawles et al. ..... 343/741
6,072,434 A 6/2000 Papatheodoron
6,204,819 B1 3/2001 Hayes et al.
6,476,767 B2 * 11/2002 Aoyama et al. ..... 343/700 MS
6,535,172 B2 * 3/2003 Hirabayashi ..... 343/725
2003/0189519 A1 * 10/2003 Rutfors et al. ..... 343/702

OTHER PUBLICATIONS

Fang–I Hsu, "Planar Near–Field to Far–Field Transformation and PIFA Antenna Suitable for Wireless LAN", Paper of Institute of Communication Engineering National Chiao Tung University of Taiwan, 2001, http//datas.ncl.edu.tw/.

* cited by examiner

*Primary Examiner*—Tan Ho
(74) *Attorney, Agent, or Firm*—Wei Te Chung

(57) ABSTRACT

A multi-band antenna for enabling an electronic device (such as a laptop computer) to operate in two frequency bands comprises an insulative substrate (30), a conductive element disposed on the substrate, and a feeder cable (40). The conductive element and the feeder cable form a planar inverted-F antenna (10, 23, 21, 25, 24, 11) operating in a lower frequency band and a planar loop antenna (10, 23, 22, 24, 11) operating in a higher frequency band.

18 Claims, 9 Drawing Sheets

Scale: 5dBi/div
Operating Frequency 2.484 GHZ
Horizontally Polarized

Scale: 5dBi/div
Operating Frequency 2.484 GHZ
Vertically Polarized

Scale: 5dBi/div
Operating Frequency 5.35 GHZ
Horizontally Polarized

Scale: 5dBI/div
Operating Frequency 5.35 GHZ
Vertically Polarized

Scale: 5dBi/div
Operating Frequency 5.725 GHZ
Horizontally Polarized

Scale: 5dBi/div
Operating Frequency 5.725 GHZ
Vertically Polarized

MULTI-BAND ANTENNA

CROSS-REFERENCE TO RELATED APPLICATIONS

This present application is related to one contemporaneously and one earlier (Dec. 9, 2002) filed US patent applications having the same title, the same inventor, and the same assignee with the invention.

BACKGROUND OF THE INVENTION

1. Field of the Invention

The present invention relates generally to an antenna, and more particularly to a multi-band antenna used with an electronic device.

2. Description of the Prior Art

The development of wireless local area network (WLAN) technology has been attended by the development of devices operating under the IEEE 802.11b standard (in the 2.45 GHz band) and the IEEE 802.11a standard (in the 5.25 GHz band). These devices benefit from a multi-band antenna. U.S. Pat. No. 6,204,819 discloses a conventional multi-band antenna. The multi-band antenna includes a first and a second conductive branches 42, 46, and is provided for use within wireless communications devices, such as radiotelephones. A first conductive branch 42 has first and second feeds 43, 44 extending therefrom that terminate at respectively a first and second micro-electromechanical systems (MEMS) switches S1, S2. The second conductive branch 46 is in adjacent, spaced-apart relationship with the first conductive branch 42. One end of the second conductive 46 branch terminates at a third MEMS switch S3 and the opposite end of the second conductive branch 46 is connected to the first conductive branch 42 via a fourth MEMS switch S4. The fourth MEMS switch S4 is configured to be selectively closed to electrically connect the first and second conductive branches 42, 46 such that the antenna radiates as a loop antenna in a first frequency band. The fourth switch S4 is also configured to open to electrically isolate the first and second conductive branches 42, 46 such that the antenna radiates as an inverted-F antenna in a second frequency band different from the first frequency band. However, the switches add manufacturing cost and complexity to the antenna. Furthermore, the three dimensional structure of the antenna occupies a large space, which is counter to the trend toward miniaturization of portable electronic devices.

Hence, an improved multi-band antenna is desired to overcome the above-mentioned disadvantages of the prior art.

BRIEF SUMMARY OF THE INVENTION

A primary object, therefore, of the present invention is to provide a multi-band antenna combining two different types of antennas for operating in different frequency bands.

A multi-band antenna in accordance with the present invention for an electronic device includes an insulative substrate, a planar conductive element disposed on a surface of the insulative substrate and a feeder cable connected to the conductive element. The conductive element includes a ground portion, a first radiating branch, a second radiating branch, a first connecting branch, a second connecting branch, a third connecting branch and a fourth connecting branch. The feeder cable includes an inner conductor connecting to the second connecting branch and a metal shielding connected to the fourth connecting branch. The ground portion, the first, second, third and fourth connecting branches, the first radiating branch and the feeder cable together form a planar inverted-F antenna for receiving or transmitting lower frequency signals. The ground portion, the first, second and fourth connecting branches, the second radiating branch and the feeder cable together form a planar loop antenna for receiving or transmitting higher frequency signals.

Other objects, advantages and novel features of the invention will become more apparent from the following detailed description of a preferred embodiment when taken in conjunction with the accompanying drawings.

DETAILED DESCRIPTION OF THE INVENTION

The present invention now will be described more fully hereinafter with reference to the accompanying drawings.

Figure 1:
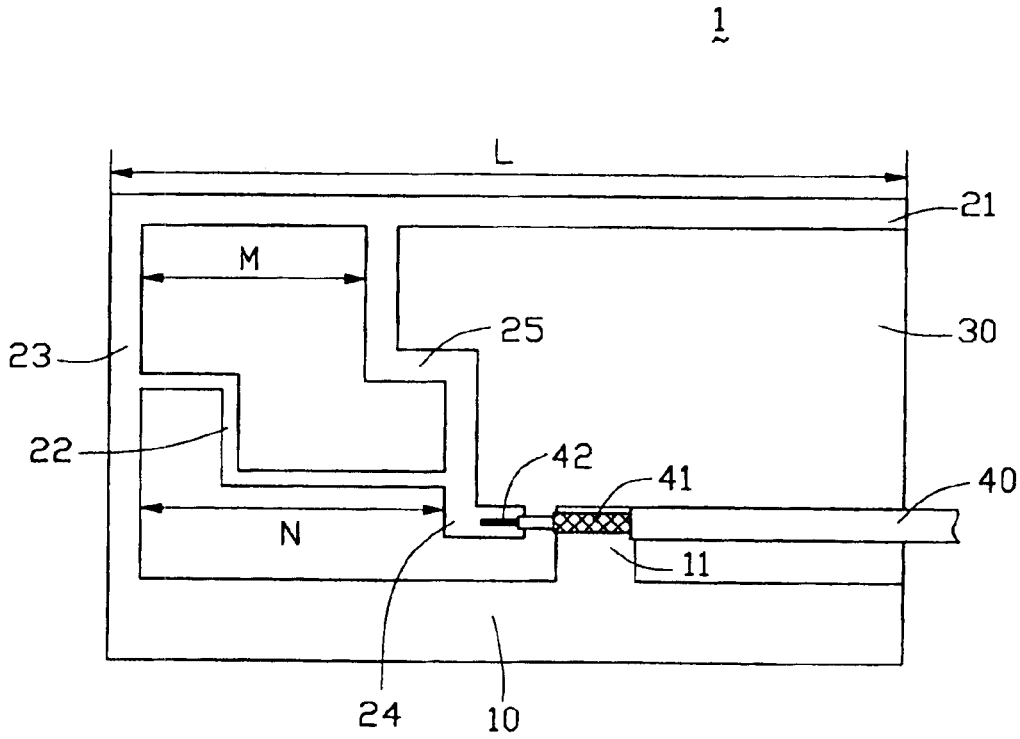
FIG. 1 is a plan view of a first embodiment of a multi-band antenna according to the present invention, with a feeder cable attached thereto.
Figure 2:
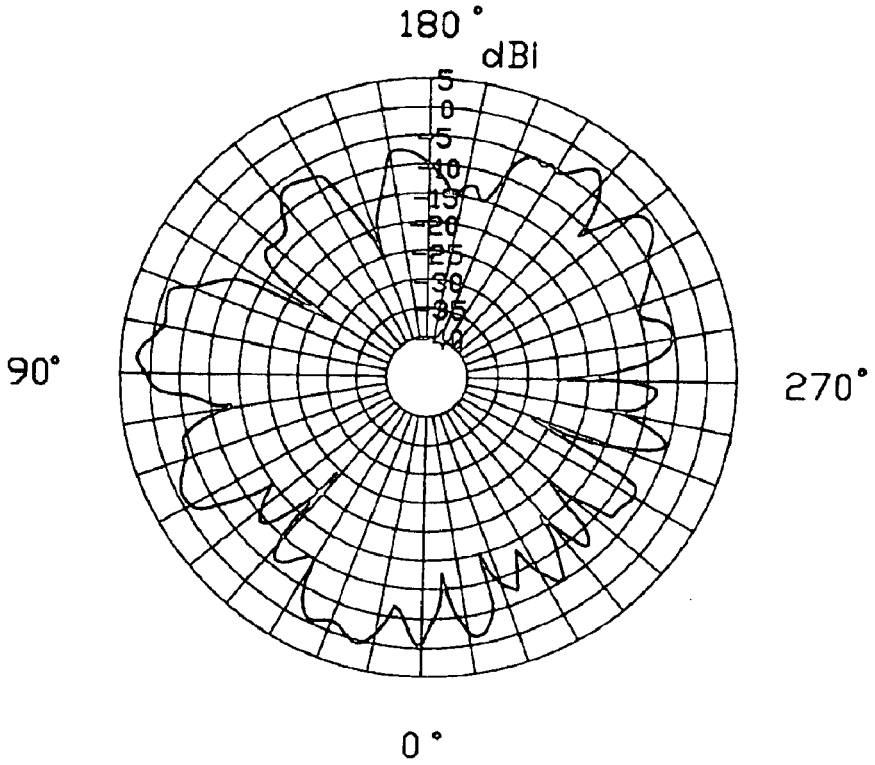
FIG. 2 is a horizontally polarized principle plane radiation pattern of the multi-band antenna of FIG. 1 operating at a frequency of 2.484 GHz.
Figure 3:
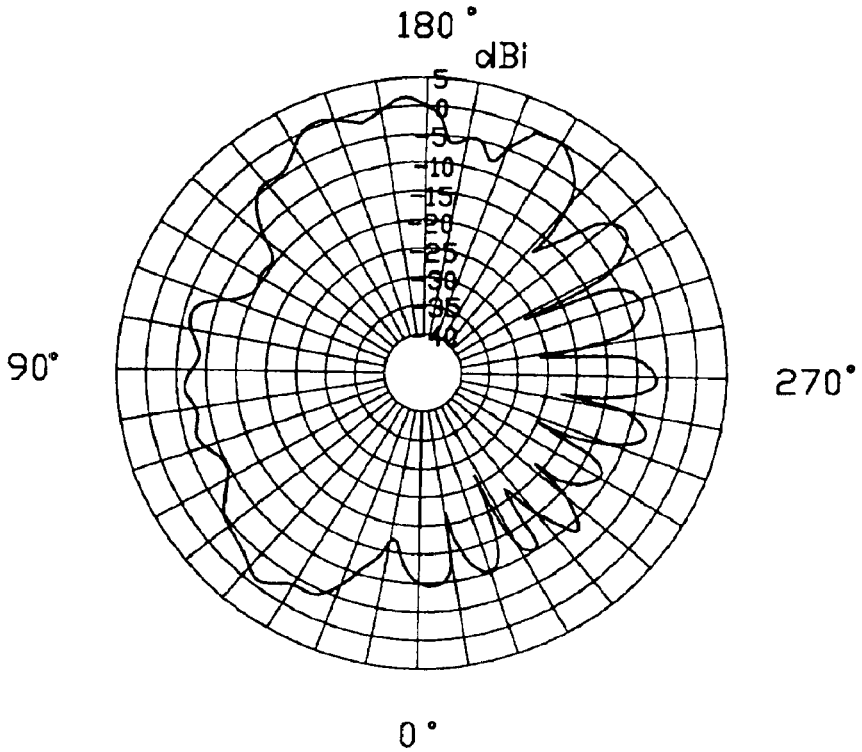
FIG. 3 is a vertically polarized principle plane radiation pattern of the multi-band antenna of FIG. 1 operating at a frequency of 2.484 GHz.
Figure 4:
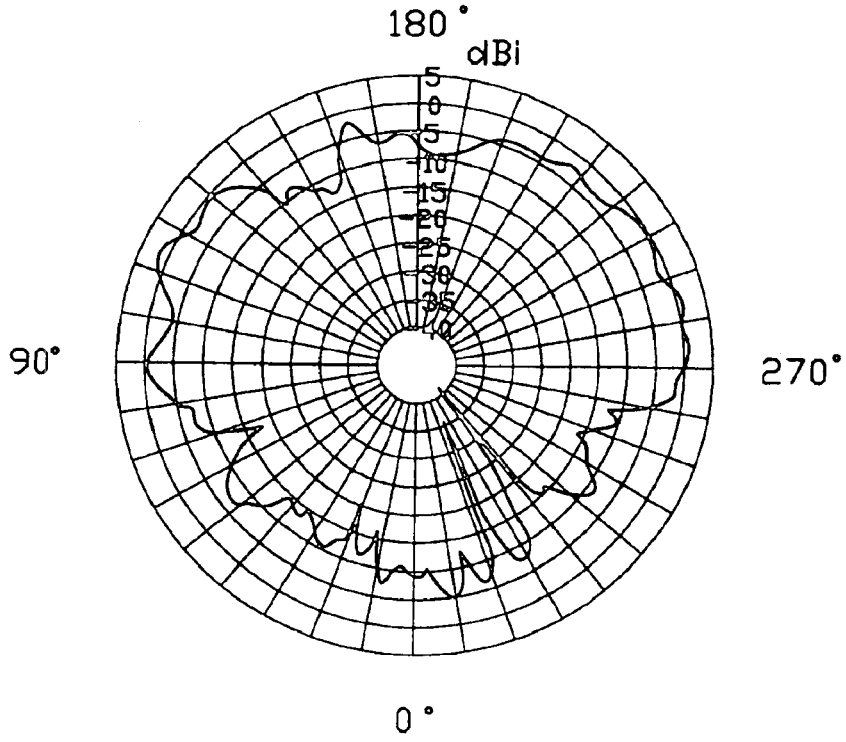
FIG. 4 is a horizontally polarized principle plane radiation pattern of the multi-band antenna of FIG. 1 operating at a frequency of 5.35 GHz.
Figure 5:
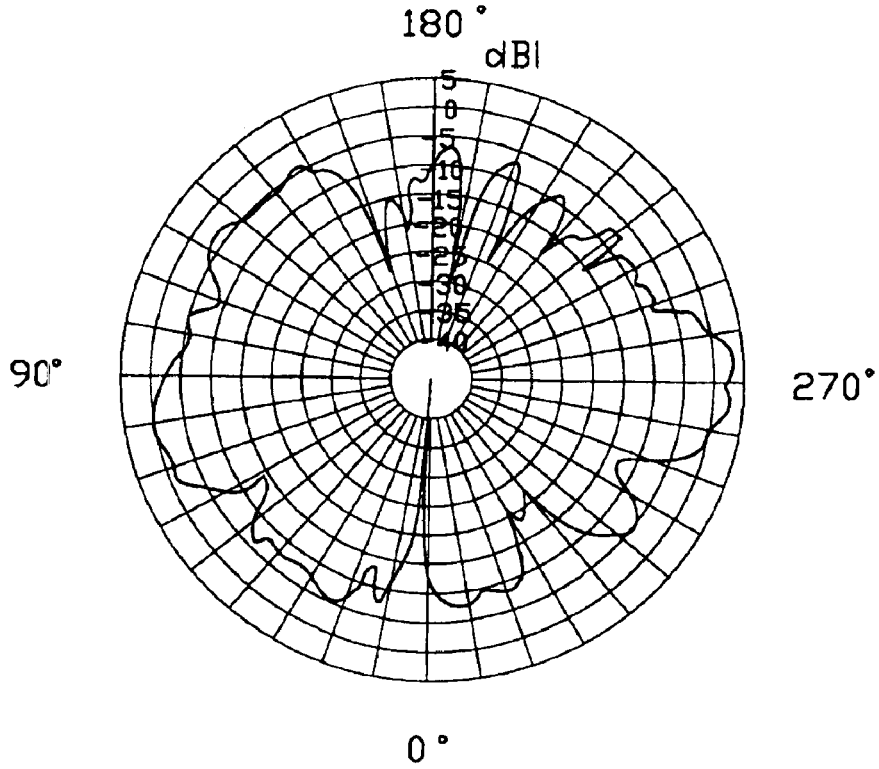
FIG. 5 is a vertically polarized principle plane radiation pattern of the multi-band antenna of FIG. 1 operating at a frequency of 5.35 GHz.
Figure 6:
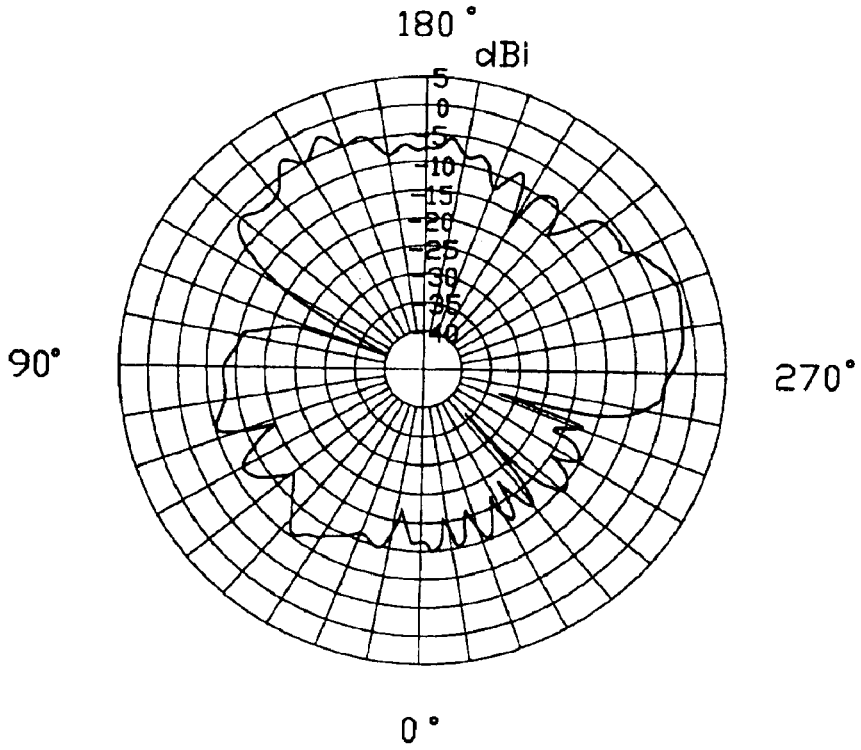
FIG. 6 is a horizontally polarized principle plane radiation pattern of the multi-band antenna of FIG. 1 operating at a frequency of 5.725 GHz.
Figure 7:
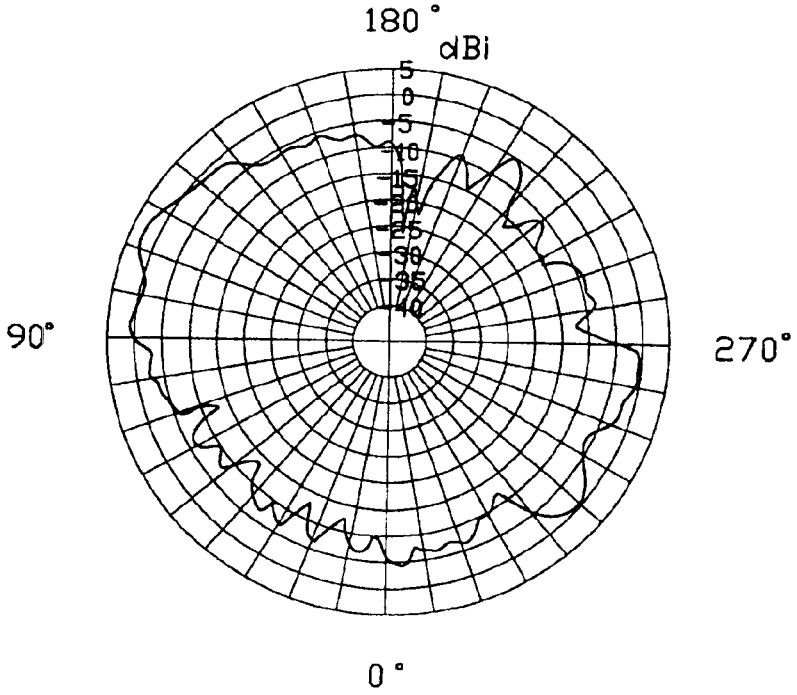
FIG. 7 is a vertically polarized principle plane radiation pattern of the multi-band antenna of FIG. 1 operating at a frequency of 5.725 GHz.

Referring to FIG. 1, a first embodiment of a multi-band antenna 1 in accordance with the present invention comprises a flat insulative substrate 30, a planar conductive element (not labeled) disposed on one surface of the substrate and a coaxial feeder cable 40 connected to the conductive element.

The conductive element is made of a metallic material and includes a ground portion 10, a first and second radiating branches 21, 22 and a first, second, third and fourth branches 23, 24, 25, 11. The elongate ground portion 10 extends adjacent one edge of the substrate 30. The first connecting branch 23 extends perpendicular to the ground portion 10 along a second edge of the substrate 30 and connects at one end (not labeled) to the ground portion 10. The first radiating branch 21 extends along a third edge of the substrate 30 perpendicular from a second end (not labeled) of the first connecting branch 23 to a fourth edge of the substrate 30. The second radiating branch 22 and the third connecting branch 25 respectively extend from middle portions of the first connecting branch 23 and the first radiating branch 21 and terminate at an end (not labeled) of the second connecting branch 24. The fourth connecting branch 11 extends perpendicular to a middle portion of the ground portion 10.

The coaxial feeder cable 40 includes an inner conductor 42 surrounded by a dielectric layer (not labeled), which is surrounded by a metal shielding 41, which is surrounded by an outer jacket (not labeled). A portion of the jacket is stripped off to expose the metal shielding 41, and a portion of the shielding and dielectric layer is stripped off to expose a length of the inner conductor 42. The inner conductor 42 is electrically connected to the second connecting branch 24, and the metal shielding 41 is electrically connected to the fourth connecting branch 11.

The ground portion 10, the first, second, third and fourth connecting branches 23, 24, 25, 11, the first radiating branch 21 and the feeder cable 40 together form an inverted-F antenna (not labeled), which operates in a lower frequency band. The ground portion 10, a part of the first connecting branch 23, the second and fourth connecting branches 24, 11 and the second radiating branch 22 form a loop trace (not labeled). The feeder cable 40 and the loop trace together form a loop antenna (not labeled), which operates in a higher frequency band.

FIGS. 2–7 respectively show horizontally and vertically polarized principle plane radiation patterns of the multi-band antenna 1 operating at frequencies of 2.484 GHz, 5.35 GHz, and 5.725 GHz. Note that each radiation pattern is close to a corresponding optimal radiation pattern and there is no obvious radiating blind area.

Figure 8:
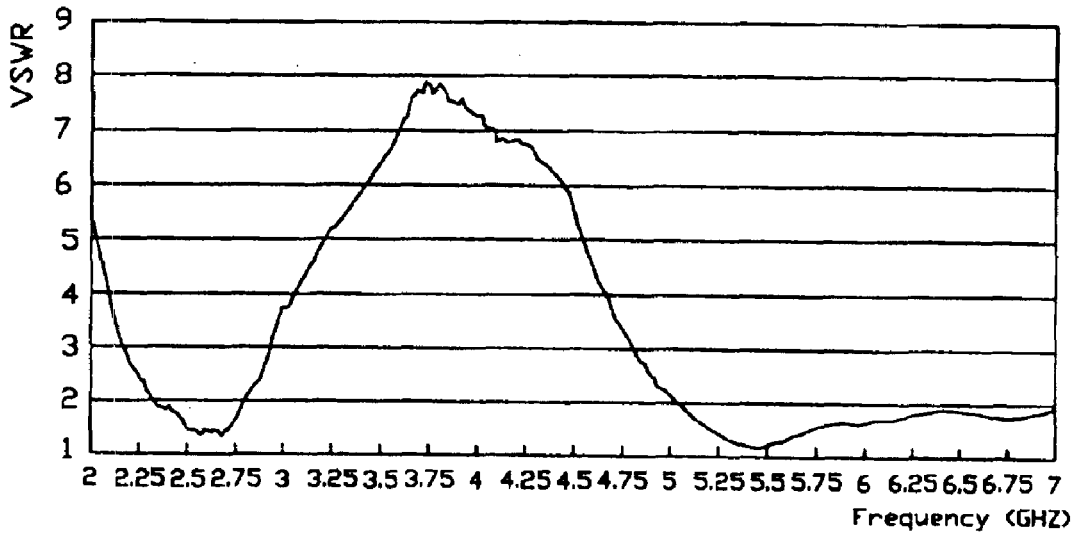
FIG. 8 is a test chart recording for the multi-band antenna of FIG. 1, showing Voltage Standing Wave Ratio (VSWR) as a function of frequency.

FIG. 8 shows a test chart recording of Voltage Standing Wave Ratio (VSWR) of the multi-band antenna 1 as a function of frequency. Note that VSWR drops below the desirable maximum value "2" in the 2.3–2.8 GHz frequency band and in the 5.05–7.00 GHz frequency band, indicating acceptably efficient operation in these two wide frequency bands, which cover more than the total bandwidth of the 802.11a and 802.11b standards.

Referring to FIG. 1, the resonance point of the multi-band antenna 1 can be adjusted by changing the length of "L", "M" or "N". For example, when the length of "L" increases, the low frequency resonance point of the multi-band antenna 1 moves to a lower frequency point; when the length of the "M" decreases, the low frequency resonance point moves to a lower frequency point and the high frequency resonance point moves to a higher frequency point; when the length of "N" decreases, the low and high frequency resonance points both move to higher frequency points.

Figure 9:
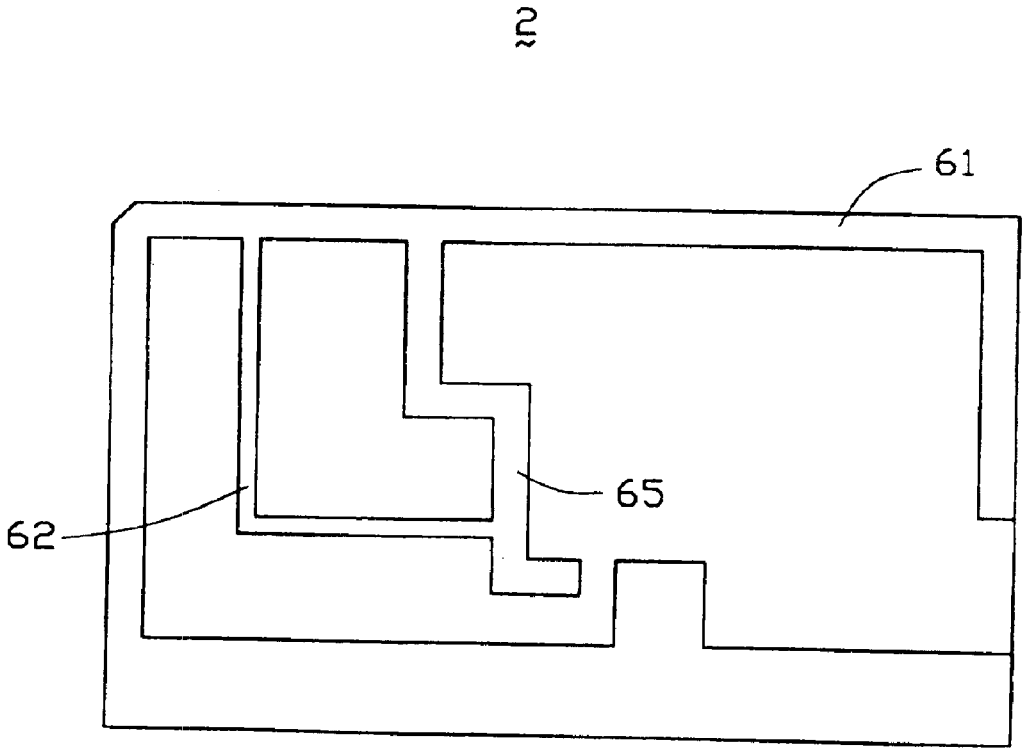
FIG. 9 is a plan view of a second embodiment of a multi-band antenna in accordance with the present invention.

Referring to FIG. 9, a second embodiment of a multi-band antenna 2 in accordance with the present invention has two differences from the first embodiment of the multi-band antenna 1. The first radiating branch 61 in the second embodiment of the multi-band antenna 2 has a first and second radiation portions (not labeled), wherein the first radiating portion is a counterpart to the first radiating branch 21 in the first embodiment, and the second radiating portion has a free end and is perpendicular to the first radiating portion and extends along the fourth edge of the substrate 30. A second radiating branch 62 is also different from the prior second radiating branch 22. The second radiating branch 62 is connected to the first radiating branch 61 in this embodiment. The different lengths of the first radiating branch and the second radiating branch provide different performances in the work frequency bands and provide different frequency resonance points.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna for an electronic device, comprising:

a first and second radiating branches;

a ground portion;

a feeder cable;

a first connecting branch, connecting with the first radiating branch and the second radiating branch;

a second connecting branch, connecting with the second radiating branch and the feeder cable; and a third connecting branch, connecting the first radiating branch, the second radiating branch and the second connecting branch;

wherein the first, second and third connecting branches, the first radiating branch, the ground portion and the feeder cable form a planar inverted-F antenna; the first and second connecting branches, the second radiating branch, the ground portion and the feeder cable form a planar loop antenna.

2. The multi-band antenna according to claim 1, further comprising an insulative substrate, on which the first and second radiating branch, the first, second and third connecting branches and the ground portion are disposed.

3. The multi-band antenna according to claim 2, further comprising a fourth connecting branch extending from the ground portion.

4. The multi-band antenna according to claim 3, wherein the feeder cable includes an inner core conductor electrically connecting to the second connecting branch and a metal shielding electrically connecting to the fourth connecting branch.

5. A multi-band antenna for an electronic device, comprising:

an insulative substrate;

a conductive element disposed on a surface of the substrate; and a feeder cable electrically connecting with the conductive element;

wherein the conductive element and the feeder cable form a planar inverted-F antenna and a planar loop antenna, wherein the planar inverted-F antenna include a first, second and third connecting branches, a first radiating branch and a ground portion.

6. The multi-band antenna according to claim 5, wherein the planar loop antenna includes a loop trace.

7. The multi-band antenna according to claim 6, wherein the loop trace includes a second radiating branch, a part of the first connecting branch, the second connecting branch and the ground portion.

8. The multi-band antenna according to claim 7, further comprising a fourth connecting branch extending form the ground portion.

9. The multi-band antenna according to claim 8, wherein the feeder cable is a coaxial cable.

10. The multi-band antenna according to claim 9, wherein the feeder cable includes an inner core conductor connecting to the second connecting branch and a metal shielding connecting to the fourth connecting branch.

11. A multi-band antenna comprising:

a substrate defining thereof lengthwise and transverse directions perpendicular to each other;

a conductive area formed on the substrate, said conductive area including:

an elongated ground portion extending on one side of the substrate along said lengthwise direction;

a first radiating section extending on the other side of the substrate along said lengthwise direction, opposite to said ground portion;

a first connecting section located on another side of the substrate, said first connecting section extending in said transverse direction and connecting said ground portion and said first radiating section, respectively;

a second radiating section extending from at least one of said first connecting section and said second radiating section generally along said lengthwise direction and between said ground portion and said first radiating section;

a second connecting section generally extending in said transverse direction beside said first connecting section and connecting said first radiating section and said second radiating section, respectively; and a feeder cable including an inner conductor connected to a third connecting section which is located around a distal end of said second connecting section away from said first radiating section; wherein said second connecting section defines a Z-like configuration with a first segment closer to said first connecting section and a second segment farther from said first connecting section.

12. The antenna according to claim 11, wherein said first segment is connected to the first radiating section, and said second segment is connected to the second radiating section.

13. The antenna according to claim 11, wherein said second radiating section defines a Z-like configuration.

14. The antenna according to claim 11, wherein said second radiating section defines a right angle configuration.

15. The antenna according to claim 11, further including a fourth connecting section extending in a transverse direction from the ground portion where an outer conductor of the feeder cable is connected.

16. The antenna according to claim 15, wherein said third connecting section and said fourth connecting section are partially aligned with each other along said transverse direction for allowing the corresponding inner conductor and outer conductor secured thereto along said transverse direction.

17. A multi-band antenna comprising:

a substrate defining thereof lengthwise and transverse directions perpendicular to each other;

a conductive area formed on the substrate, said conductive area including:

an elongated ground portion extending on one side of the substrate along said lengthwise direction;

a first radiating section extending on the other side of the substrate along said lengthwise direction, opposite to said ground portion;

a first connecting section located on another side of the substrate, said first connecting section extending in said transverse direction and connecting said ground portion and said first radiating section, respectively;

a second radiating section extending from at least one of said first connecting section and said first radiating section generally along said lengthwise direction and between said ground portion and said first radiating section;

a second connecting section generally extending in said transverse direction beside said first connecting section and connecting said first radiating section and said second radiating section, respectively;

a third connecting section located around a distal end of the second connecting section away from said first radiating section;

a fourth connecting section extending in a transverse direction from the ground portion toward said first radiating section; and a feeder cable including an inner conductor and an outer conductor respectively connected to said third connecting section and said fourth connecting section.

18. The antenna according to claim 17, wherein said third connecting section and said fourth connecting section are partially aligned with each other along said transverse direction for allowing the corresponding inner conductor and outer conductor secured thereto along said transverse direction.

* * * * *